United States Patent [19]

Walter et al.

[11] 4,274,350

[45] Jun. 23, 1981

[54] SEWING MACHINE ATTACHMENT

[75] Inventors: Merrill H. Walter, Natick, Mass.; Stanley Jacobs, Ft. Lauderdale, Fla.

[73] Assignee: Beatrice Foods Company, Chicago, Ill.

[21] Appl. No.: 118,488

[22] Filed: Feb. 4, 1980

[51] Int. Cl.[3] ..... D05B 29/00

[52] U.S. Cl. ..... 112/235

[58] Field of Search ..... 112/235, 236, 322, 318, 112/60, 61, 240

[56] References Cited

U.S. PATENT DOCUMENTS

| | | | |
|---|---|---|---|
| 495,814 | 4/1893 | Laskey | 112/235 X |
| 1,823,546 | 9/1931 | Johnson | 112/235 |
| 2,907,291 | 10/1959 | Schrader | 112/235 X |
| 3,670,678 | 6/1972 | Ziegler | 112/235 |
| 3,933,106 | 1/1976 | Murray | 112/235 |

*Primary Examiner*—H. Hampton Hunter

*Attorney, Agent, or Firm*—Wolf, Greenfield & Sacks

[57] ABSTRACT

The attachment is primarily used as a replacement for the conventional presser foot typically employed on an industrial sewing machine, and is in particular useful when stitching multiple layer fabrics having synthetic backings. The attachment is for pressing the fabric being stitched against parallel arranged feed dogs and includes a wheel assembly frame supported from one end of a presser arm which is, in turn, pivotally supported at its other end from the machine. The wheel assembly supports a wheel mounted for rotation about a substantially horizontal axis and preferably of a yieldable rubber or rubber-like material that overlies one of the feed dogs of the sewing machine, and a presser foot mounted beside the wheel having a lower pressing surface and overlying a second feed dog of the sewing machine.

10 Claims, 5 Drawing Figures

SEWING MACHINE ATTACHMENT

BACKGROUND OF THE INVENTION

The present invention relates in general to an attachment for a sewing machine particularly used with an industrial sewing machine. More particularly, the invention relates to an attachment that is meant to replace the conventional presser foot typically employed on an industrial sewing machine for improving the overall sewing or stitching operation, particularly when stitching multiple layer fabrics having synthetic backings.

Prior art patents in the same general field include U.S. Pat. No. 2,907,291 to Schrader, U.S. Pat. No. 1,069,836 to Wieczoreck, and U.S. Pat. No. 1,823,546 to Johnson. Of these patents, the Schrader reference, in particular, discusses the problems associated with the stitching or sewing of fabrics constructed of the newer synthetic fibers. Many of the fabrics that are stitched today have a backing of a material such as foam rubber, vinyl or latex. These fabrics, when stitched to one another or to other fabrics, cause a substantial drag, and with the use of a conventional presser foot, this drag problem is not avoided. Such a conventional presser foot may be the type used on the Union Special Corporation, Machine Item No. 39-500. This conventional presser foot is simply a foot-like member pivotally secured to a presser arm.

According, one object of the present invention is to provide an improved presser foot attachment that alleviates previous drag problems, and at the same time avoids any problems of uneven stitching, puckering, uneven feeding, and other similar problems. The attachment of this invention may be employed with vinyl and nylon and any other man-made fiber products that require stitching, binding, joining, and/or fringing.

Another object of the present invention is to provide an improved attachment for a sewing machine for providing improved pressing of the fabric to be stitched against feed dogs under the fabric.

A further object of the present invention is to provide a sewing machine attachment as set forth in the preceding object which is, in particular, adapted for the stitching of synthetic fabrics and, in particular, those having a backing of such material as foam rubber, vinyl, nylon or latex.

Still another object of the present invention is to provide a sewing machine attachment as set forth in the preceding objects and which can be used either on narrow bite or wide bite sewing machines.

Still a further object of the present invention is to provide an improved presser foot-type sewing machine attachment that can be used with little or no modification on a variety of different types of sewing machines.

Another object of the present invention is to provide an improved presser foot-type sewing machine attachment that is, in particular, useful with a double feed dog arrangement.

Still another object of the present invention is to provide an improved presser foot-type sewing machine attachment which is quite durable, having a minimum of part wear, and that requires little or no maintenance.

SUMMARY OF THE INVENTION

To accomplish the foregoing and other objects of this invention, there is provided a sewing machine attachment for pressing a fabric that is to be stitched against feed dogs. The attachment of this invention may be used as a replacement for a conventional presser foot typically employed on an industrial sewing machine. This attachment is particularly useful when stitching multiple layer fabrics having synthetic backings. The attachment comprises an arm adapted to be pivotally supported at one end from the sewing machine and carrying a wheel assembly frame on its other free end. The wheel assembly frame has mounted thereon a wheel which is mounted for rotation about a substantially horizontal axis. The wheel is preferably constructed of a yieldable material such as urethane and is adapted to overlie a first feed dog of the sewing machine. Also mounted from the wheel assembly frame is a presser foot. This is mounted beside the wheel and has a lower pressing surface disposed closely adjacent to the plane of the material engaging surface of the wheel. This presser foot is positioned to overlie a second feed dog of the sewing machine. Both the wheel and the presser foot are supported in a manner to permit adjustment of the height of the wheel and presser foot. In the disclosed embodiment, the wheel assembly frame carries a pair of supports, one extending substantially horizontally to each side of the frame. Pins, in turn, extend downwardly from each of the supports, one of the pins carrying the wheel and the other of the pins carrying the presser foot. The wheel is preferably supported by ball bearing means for free rotation about an axis that is disposed at a slightly small angle from the horizontal.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
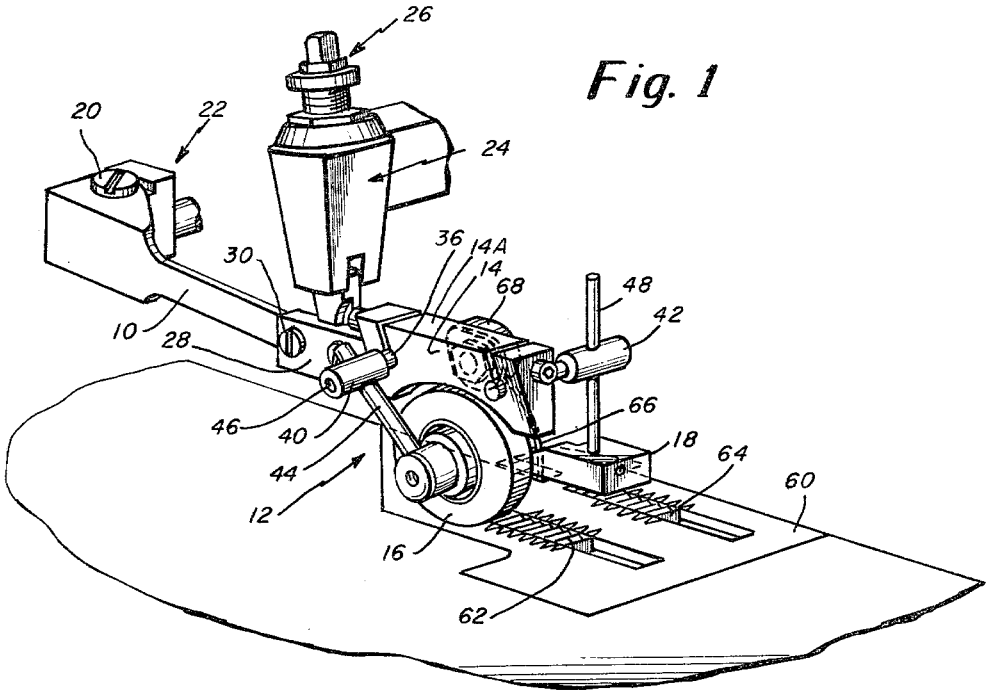
FIG. 1 is a perspective view of the attachments of this invention showing the wheel and presser foot in alignment with the corresponding feed dogs.
Figure 2:
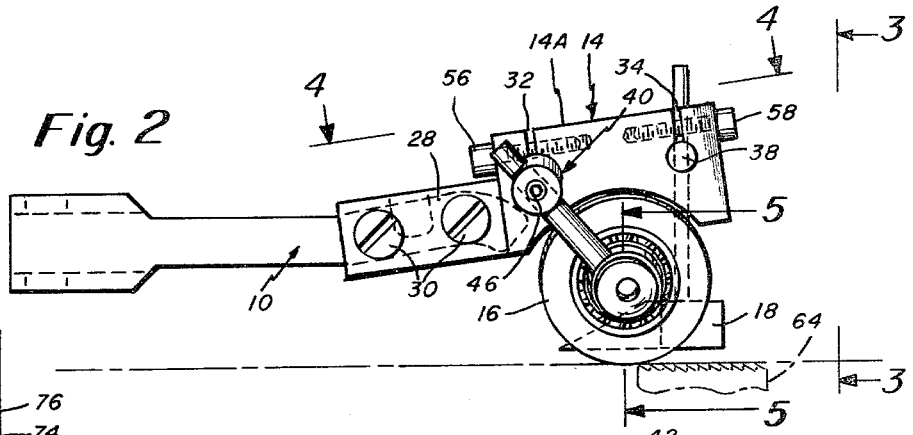
FIG. 2 is a side elevation view of the attachment depicted in FIG. 1.

The drawing shows a preferred embodiment for the sewing machine attachment of this invention. This attachment may be used with, for example, a Union Special overlock sewing machine such as manufactured by the Union Special Company of Chicago, Illinois. Although this attachment is particularly adapted for the Union Special 39-500 overlock machine, it may also be used on other makes and models of machines, possibly requiring some slight modification. In the drawing, to simplify the discussion, only the attachment of the invention is shown and no major parts of the sewing machine are disclosed except parts of the machine to which the attachment secures.

The attachment shown in the drawing comprises a presser arm 10, wheel assembly 12, wheel assembly frame 14, contact wheel 16, and presser foot 18. The presser arm 10 is pivottally supported by means of pin 20 from a presser arm support 22 which in the Union Special machine is referred to as a foot lifter level shaft. The securing of the attachment to the sewing machine also includes member 24 which is conventional and which is a means for setting the presser arm pressure. This pressure is set by means of a locking adjustment 26 at the top of a member as depicted.

The wheel assembly frame 14 is secured at its end 28 to the presser arm 10 by means of a pair of bolts 30. The bolts 30 may pass through the end 28 into tapped holes in the arm 10. The main portion of the frame 14 supports the wheel 16 from one side thereof, and the presser foot 18, from the other side thereof. The frame 14 has a top wall surface 14*a* which is provided with transverse slots 32 and 34 which terminate at their bottom at respective cross holes 36 and 38. The holes 36 and 38 in turn carry respective pins 40 and 42. The wheel 16 is supported as discussed hereinafter, from the pin 40 while the presser foot 18 is supported as discussed hereinafter, from the pin 42. Pin 40 has two sections including a smaller diameter end that fits within the hole 36. Similarly, the pin 42 includes two sections including a smaller diameter section that fits within the hole 38. The larger diameter end of the pin 40 has a cross hole for receiving the pin 44. There is also a set screw 46 provided in the end of pin 40 which can lock the pin 44 in the proper fixed position. The larger diameter end of the pin 42 also has a cross hole for receiving the elongated pin 48. The pin 42 also has an associated set screw 50 for securing the pin 48 in a fixed position.

In addition to the set screw adjustments provided by screws 46 and 50, there are two additional Allen head type adjustment screws 56 and 58. The screw or bolt 56 is adapted to compress the slot 32 to hold the pin 40 in the desired position. Similarly, the set screw or bolt 58 may be adjusted to compress the slot 34 and thus hold the pin 42 in a fixed position. By loosening either of these set screws the corresponding pin 40, 42 may be moved to different positions to adjust them.

FIG. 1 shows the throat plate 60 having associated therewith feed dogs 62 and 64 disposed in parallel with each other and spaced apart. The needle of the machine is shown in FIG. 1 and in phantom. This needle 66 is supported in a conventional manner from member 68. The wheel 16 and the presser foot 18 are adjusted for alignment with the respective feed dogs 62 and 64.

Figure 5:
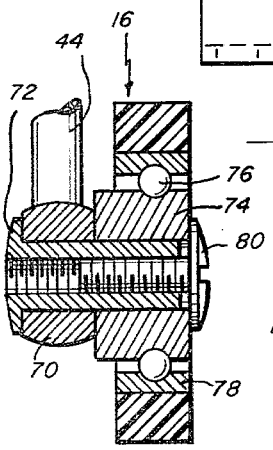
FIG. 5 is a cross-sectional view through the wheel as taken along line 5—5 of FIG. 2.
Figure 4:
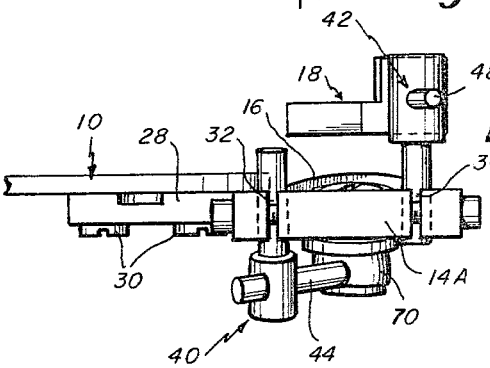
FIG. 4 is a plan view of the attachment as taken along line 4—4 of FIG. 2.
Figure 3:
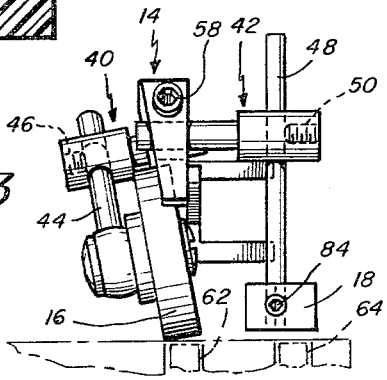
FIG. 3 is a front elevation view as taken along line 3—3 of FIG. 2.

FIG. 5 is a cross sectional view showing the internal construction of the wheel 16 and the manner in which it is attached to the pin 14. For this purpose the pin 44 is provided with an end 70 for receiving an internally threaded rivet 72 that extends through the end 70 and into a hub 74. The hub 74 forms an inner race for ball bearings 76 which are also supported by the outer race 78. The wheel 16 is constructed primarily of a yieldable material which is preferably urethane and supported on the outer race 78. There is also provided a bolt 80 that is received on the internally threaded rivet 72 and firmly secures the hub 74 to the pin 44. However, the wheel 16 is free to rotate about the ball bearings. As depicted in FIG. 3, it is noted that the axis of the wheel 16 is at a slight angle to the horizontal. FIG. 3 also clearly depicts the positional relationship between the wheel 16 and the feed dogs 62.

Also depicted in FIG. 3 is the other feed dog 64 with the presser foot 18 aligned therewith. The presser foot 18 has a front section with a flat top wall, and a rear section that is rearwardly tapered. The presser foot 18 is secured to the pin 48 and is fixed in position by means of the set screw 84.

Having described one preferred embodiment of the invention, it should now be apparent to those skilled in the art that numerous modifications can be made to this embodiment with such modifications and additional embodiments contemplated as falling within the scope of the invention. For example, the presser arm construction disclosed herein is particularly adapted for use with a Union Special Machine. However, different configurations of arms may be provided depending upon a particular machine with which the attachment is to be used.

What is claimed is:

1. A sewing machine attachment for pressing a fabric to be stitched against feed dogs, comprising;

an arm adapted to be supported at one end and carrying a wheel assembly frame at the other end, a wheel mounted on the assembly frame for rotation about a substantially horizontal axis and having a yieldable material-engaging surface adapted to overlie a feed dog of the machine;

presser foot means mounted on the assembly frame beside the wheel and having a lower pressing surface disposed closely adjacent to the plane of the material engaging surface of the wheel and adapted to overlie a second feed dog of the machine, and means for adjusting the height of the wheel and the presser foot means on the assembly frame.

2. A sewing machine attachment as defined in claim 1 further characterized by;

said assembly frame carrying a pair of supports, one extending substantially horizontally to each side of the frame, and a pin extending downwardly from each of the supports, one of the pins carrying the wheel and the other of the pins carrying the presser foot means.

3. A sewing machine attachment as defined in claim 1 further characterized by;

said wheel having a ball bearing hub for free rotation about its axis and having said material-engaging surface of urethane.

4. A sewing machine attachment as defined in claim 2 further characterized by;

said wheel having a ball bearing hub for free rotation about its axis and said material-engaging surface being of urethane.

5. A sewing machine attachment as defined in claim 1 further characterized by;

said yieldable material-engaging surface being made of urethane.

6. A sewing machine attachment as defined in claim 1 further characterized by;

a wheel mounting means as defined by a hub defining an axis disposed slightly from the horizontal whereby the wheel material-engaging surface engages with the feed dog slightly tapered from the horizontal.

7. A sewing machine attachment as defined in claim 1 further characterized by;

said assembly frame carrying support members extending one to each side of the frame with one of said support members disposed at a front end of said frame and the other of said support members disposed closer to a rear end of said frame.

8. A sewing machine attachment as defined in claim 7 further characterized by;

the forward support member carrying said presser foot and the rearward support member carrying said wheel.

9. A sewing machine attachment as defined in claim 8 further characterized by;

pins extending downwardly from each of said support members, one for carrying the wheel and the other for carrying the presser foot with said presser foot pin being disposed substantially vertically while said wheel pin is disposed at an angle to the vertical.

10. A sewing machine attachment as defined in claim 9 further characterized by;

said means for adjusting including separate means one for the adjustment of the height of the wheel and the other for the adjustment of the presser foot means, said wheel adjustment and means being carried by said rearward support member and said presser foot adjustment means being carried by said forward support member.

* * * * *